US011524749B2

(12) United States Patent
Schmidt

(10) Patent No.: US 11,524,749 B2
(45) **Date of Patent: *Dec. 13, 2022**

(54) PERSONAL WATER CRAFT FOOT WELL DRAINAGE SYSTEM

(71) Applicant: Richard W. Schmidt, Crownsville, MD (US)

(72) Inventor: Richard W. Schmidt, Crownsville, MD (US)

( * ) Notice: Subject to any disclaimer, the term of this patent is extended or adjusted under 35 U.S.C. 154(b) by 3 days.

This patent is subject to a terminal disclaimer.

(21) Appl. No.: 17/126,969

(22) Filed: Dec. 18, 2020

(65) Prior Publication Data

US 2021/0101663 A1 Apr. 8, 2021

Related U.S. Application Data

(63) Continuation of application No. 16/520,701, filed on Jul. 24, 2019, now Pat. No. 10,926,845.

(60) Provisional application No. 62/825,103, filed on Mar. 28, 2019.

(51) Int. Cl.
*B63B 32/20* (2020.01)

(52) U.S. Cl.
CPC ..... *B63B 32/20* (2020.02)

(58) Field of Classification Search
CPC ..... B63B 32/20
See application file for complete search history.

(56) References Cited

U.S. PATENT DOCUMENTS

| | | | | |
|---|---|---|---|---|
| 1,663,777 | A * | 3/1928 | Sargent | E03F 5/0407 114/182 |
| 2,949,879 | A * | 8/1960 | Kehn | B63B 13/00 114/271 |
| 4,404,981 | A * | 9/1983 | Valenti | F16K 13/04 137/67 |
| 4,913,075 | A | 4/1990 | Rohr, Jr. | |
| 4,945,852 | A | 8/1990 | Kobayashi | |
| 4,984,528 | A | 1/1991 | Kobayashi | |
| 5,385,108 | A | 1/1995 | Thompson | |
| 6,038,992 | A | 3/2000 | Smith | |
| 6,145,458 | A * | 11/2000 | Hattori | B63B 34/10 114/55.57 |
| 6,338,309 | B1 | 1/2002 | Michelson | |
| 6,773,319 | B1 | 8/2004 | Carlini, Jr. | |
| 6,860,217 | B1 | 3/2005 | Beechie | |
| 7,210,423 | B2 | 5/2007 | Haugen | |
| 7,452,255 | B2 | 11/2008 | Hirade et al. | |
| 9,371,112 | B2 | 6/2016 | Sarnowski et al. | |

(Continued)

OTHER PUBLICATIONS

Anonymous, "Thread: Draining footwells on MSX-140", Greenhulk.net, http://greenhulk.net/forums/showthread.php?t=31862,Jul. 13, 2007, 2 pages.

(Continued)

*Primary Examiner* — Stephen P Avila
(74) *Attorney, Agent, or Firm* — MH2 Technology Law Group LLP; Stuart I. Smith

(57) ABSTRACT

A personal water craft includes a hull; a deck attached to, or integral with, the hull; a foot well having a foot well floor that is configured to receive a foot of a user of the personal water craft; and a drainage system configured to drain liquid from the foot well, the drainage system having a tube extending from the foot well floor to a location outside the hull.

20 Claims, 8 Drawing Sheets

(56) References Cited

U.S. PATENT DOCUMENTS

| | | | |
|---|---|---|---|
| 10,059,406 | B1 | 8/2018 | Eberstadt, III |
| 10,926,845 | B2 * | 2/2021 | Schmidt ..... B63B 34/10 |
| 2003/0116073 | A1 | 6/2003 | Johnston |
| 2006/0060121 | A1 | 3/2006 | Sollazzo |
| 2007/0095268 | A1 | 5/2007 | Bourret et al. |
| 2017/0320545 | A1 | 11/2017 | Daley et al. |

OTHER PUBLICATIONS

Anonymous, "Footwell Drains", www.yamaha-motor.com, accessed Jul. 23, 2019, 1 page.

Perko Inc., "Underwater Hardware—Thru-Hulls", https://www.perko.com/catalog/category_products/underwater_hardware-thru_hulls/, accessed Jul. 23, 2019, 7 pages.

SouthCo Inc., "Thru Hulls", https://www.southco.com/static/Literature/M7-ThruHulls.en.pdf, accessed Jul. 23, 2019, 5 pages.

Groco LLP, "Thru Hull Fittings", https://www.groco.net/products/fittings/thru-hull-fittings, accessed Jul. 23, 2019, 6 pages.

CBGjr, "How to Make a Kayak Drainage Port", https://www.instructables.com/id/How-to-make-a-Kayak-drainage-port/, accessed Jul. 23, 2019, 9 pages.

Overton's Inc., "Overton's-Thru-Hull Fittings", https://www.overtons.com/pumps-plumbing/plumbing-fittings/thru-hull-fittings, accessed Jul. 23, 2019, 2 pages.

* cited by examiner

PERSONAL WATER CRAFT FOOT WELL DRAINAGE SYSTEM

FIELD OF THE INVENTION

The invention is directed to a drainage system for a water craft. More particularly, embodiments of the invention are directed to a drainage system for the foot wells of a personal water craft.

An example of an application for the invention is a tube system installed, either originally or retrofit, into the foot wells of a personal water craft to drain water from the foot wells that would otherwise collect in the foot wells.

BACKGROUND OF THE INVENTION

Many people enjoy personal water craft ("PWC") of the type that have a central seating area and a foot well located on either side of the central seating area. Water can collect in the foot wells as the PWC is operated and also as the PWC sits when not in use.

Applicants recognized an improvement to the above arrangement and implement that improvement in embodiments of the invention.

SUMMARY

The water that can collect in the foot wells of a PWC can be annoying to the rider because their feet are often sitting in water a large portion of the time they are riding the PWC. Also, when the PWC is stopped, the water can remain in the foot wells, resulting in the rider's feet being submerged in water.

Many large PWCs that hold multiple riders are so stable that water does not enter the foot wells when the riders get on and off the PWC. In some of these cases, little or no water enters the foot wells during operation. As a result, a functioning drainage system can result in the rider's feet remaining essentially dry.

During storage, rainwater can collect in the foot wells of conventional PWCs. This rainwater often becomes a slimy substance that includes leaves, dirt, insects such as mosquitos, mold, and other material that can discolor the foot wells and cause the owner of the PWC to clean the foot wells every time the PWC is used.

The invention achieves the benefit of providing a user of a PWC with a system for draining water from the foot wells of the PWC. Embodiments of the system include a tube that runs from the foot well to the outside of the hull of the PWC.

Particular embodiments of the invention are directed to a personal water craft having a hull; a deck attached to, or integral with, the hull; a foot well having a foot well floor that is configured to receive a foot of a user of the personal water craft; and a drainage system configured to drain liquid from the foot well, the drainage system having a tube extending from the foot well floor to a location outside the hull.

In some embodiments, an entry opening of the tube is a first horizontal distance from a forward most extremity of the personal water craft, an exit opening of the tube is a second horizontal distance from the forward most extremity of the personal water craft, and the first distance is smaller than the second distance.

Particular embodiments of the invention are directed to a drainage system for a foot well of a personal water craft, the personal watercraft having a hull. The drainage system includes a tube extending from the footwell to a location outside of the hull, the tube having an entry opening configured to be located in the foot well and having a center, edges of the tube at the entry opening being substantially located in an entry plane, and an exit opening configured to be located in the hull and having a center, edges of the tube at the exit opening being substantially located in an exit plane. The entry plane is non-perpendicular to a straight line through the center of the entry opening and the center of the exit opening, and the exit plane is non-perpendicular to the straight line through the center of the entry opening and the center of the exit opening.

Particular embodiments of the invention are directed to a drainage system for a foot well of a personal water craft, the personal watercraft having a hull. The drainage system includes an outer tube extending from the foot well to a location outside of the hull, the outer tube being configured to receive an insert; and a cross-member extending across an interior of the tube, the cross-member being configured to support the insert and prevent the insert from passing completely through the tube

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a personal water craft ("PWC"). In particular, embodiments of the invention provide a drain in a foot well of a PWC (or some other area that collects water on a watercraft) that drains water from the foot well (or other area) to an area outside of the watercraft. For simplicity, the term PWC will be used to represent all forms of watercraft, including personal water craft and other watercraft. By draining the water to a location outside of the PWC, no bilge pumps or other draining mechanisms need to be added to the PWC. By draining the water to an area outside of the PWC, problems (such as, for example, swamping or sinking) associated with draining water to a location inside the hull of the PWC are avoided.

Figure 1:
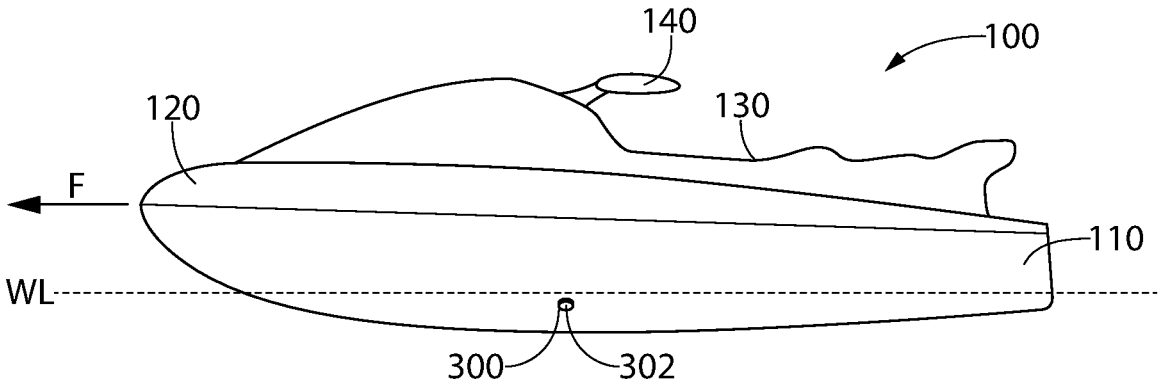
FIG. 1 is a schematic side view of a personal water craft in accordance with embodiments of the invention.
Figure 2:
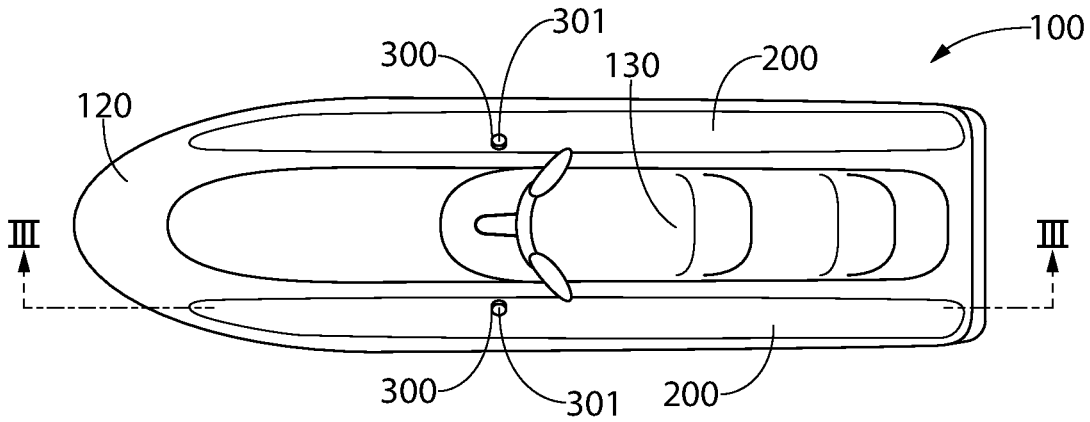
FIG. 2 is a schematic top view of the personal water craft of FIG. 1.
Figure 3:
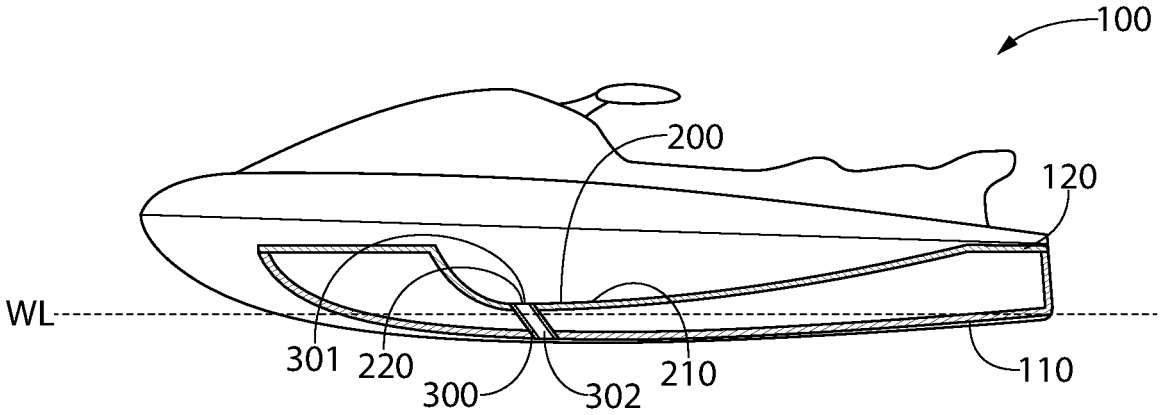
FIG. 3 is a schematic sectional view of the personal water craft along section line III-III of FIG. 2.

FIGS. 1-3 show an example of a PWC 100 in accordance with the invention. PWC 100 has a hull 110, a deck 120, a seat 130 and handlebars 140. PWC 100 has a motor (not shown) and, in some embodiments, a jet or pump drive system (not shown). PWC 100 has a foot well 200 on either side of seat 130. Foot well 200 has a bottom 210 where water can collect as described above. Foot well 200 has a low point 220 where a drainage system 300 is located so that water that enters foot well 200 can drain out of foot well 200 and out of PWC 100.

Drainage system 300 provides a passageway from an entry opening 301 in each foot well 200 to an exit opening 302 in the outside of hull 110. In embodiments, entry opening 301 is above a design waterline WL. In embodiments, exit opening 302 is below design waterline WL. Design waterline WL is a line on hull 110 at which the surface of the water contacts hull 110 when PWC 100 is stationary and floating in the water in a normal resting position. In some embodiments, the normal resting position is with one passenger and a predetermined weight of gear loaded on PWC 100. In embodiments, entry opening 301 is above an empty waterline, the empty waterline being a line on hull 110 at which the surface of the water contacts hull 110 when PWC 100 is stationary and floating in the water with no passenger or gear loaded on PWC 100. In embodiments, entry opening 301 is above a fully loaded waterline, the fully loaded waterline being a line on hull 110 at which the surface of the water contacts hull 110 when PWC 100 is stationary and floating in the water with a maximum design weight in passengers and gear loaded on PWC 100. In embodiments, exit opening 302 is below the empty waterline. In embodiments, exit opening 302 is below the fully loaded waterline. In embodiments, entry opening 301 is above the fully loaded waterline and exit opening 302 is below the empty waterline.

Drainage system 300 can be molded into the hull and deck of a new PWC or can be retrofitted into an existing PWC.

FIGS. 4-14 show several examples of drainage system 300 that can be either a part of a new PWC or can be retrofitted into an existing PWC. Drainage systems 300 provide a tube through which foot wells 200 can be constantly drained. In some embodiments, the tube is unobstructed to provide a clear path through which leaves or other material can pass without blocking the tube.

Figure 4:
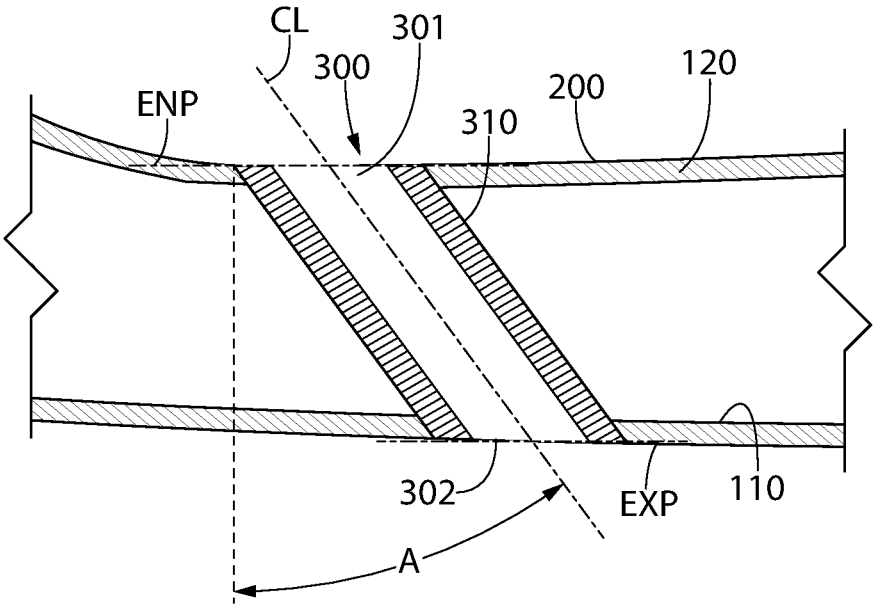
FIG. 4 is a sectional view of an example of an embodiment of the invention.
Figure 5:
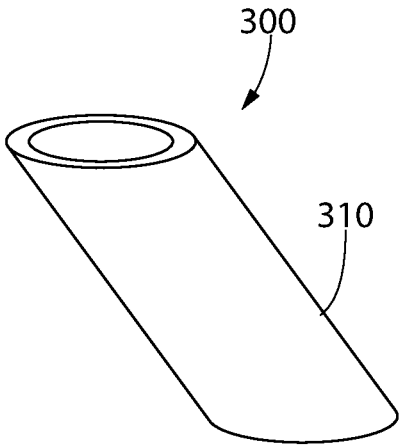
FIG. 5 is a perspective view of the embodiment shown in FIG. 4.

In FIGS. 4 and 5, drainage system 300 has a tube 310 that is fixed to hull 110 and deck 120 by an adhesive or other fastening method. In embodiments, one or both ends of tube 310 can be removed from hull 110 and/or deck 120 if deck 120 needs to be removed from hull 110. Tube 310 is installed at an angle A relative to vertical. Tube 310 can be installed at any angle A between vertical and something less than horizontal. In embodiments, angle A is between 10 degrees and 70 degrees. In embodiments, angle A is between 20 degrees and 60 degrees. In embodiments, angle A is between 30 degrees and 45 degrees. The smaller angle A is, the less likely it is that water will enter foot well 200 through tube 310 when the PWC is operated in reverse. The larger angle A is, the less likely it is that water will enter foot well 200 through tube 310 when the PWC is operated in the forward direction. The larger angle A is, the larger a suction force is that results from water flowing past the lower end of tube 310 when the PWC is operated in the forward direction. The inventor has determined that an angle A of between 30 degrees and 45 degrees provides good drainage and good prevention of water entering foot well 200 through tube 310. These angles apply to any of the embodiments of the invention.

In embodiments, edges of tube 310 at entry opening 301 of the tube (located in this case in foot well 200) are substantially located in an entry plane ENP. If a floor of foot well 200 is flat (planar), then, in embodiments, the upper edges of tube 310 at entry opening 301 are located in entry plane ENP. In some water craft, the floor of foot well 200 is not completely flat (not completely planar), but can be represented by plane ENP for the purpose of determining the location of the upper edges of tube 310 at entry opening 301 and it can be said that edges of tube 310 at entry opening 301 of the tube are substantially located in entry plane ENP. In this context, the term "substantially" is to be construed as meaning that although the upper edges of tube 310 do not all exist in one plane, an entry plane (ENP) can be determined that represents an angle at which the edges of entry opening 301 are positioned relative to a center line CL of tube 310 (see FIG. 4).

Similarly, in embodiments, edges of tube 310 at exit opening 302 of the tube (located in this case in hull 110) are substantially located in an exit plane EXP. If hull 110 is flat (planar) at the location of exit opening 302, then, in embodiments, the lower edges of tube 310 at exit opening 302 are located in exit plane EXP. In some water craft, hull 210 is not completely flat (not completely planar) at exit opening 302, but can be represented by plane EXP for the purpose of determining the location of the lower edges of tube 310 at exit opening 302 and it can be said that edges of tube 310 at exit opening 302 of the tube are substantially located in exit plane EXP. In this context, the term "substantially" is to be construed as meaning that although the lower edges of tube 310 do not all exist in one plane, an exit plane (EXP) can be determined that represents an angle at which the edges of exit opening 302 are positioned relative to center line CL of tube 310 (see FIG. 4).

FIG. 5 shows tube 310 of FIG. 4 detached from PWC 100. In this example, tube 310 is circular in cross-section. In other examples, tube 310 is oval or some other shape in cross section.

Figure 6:
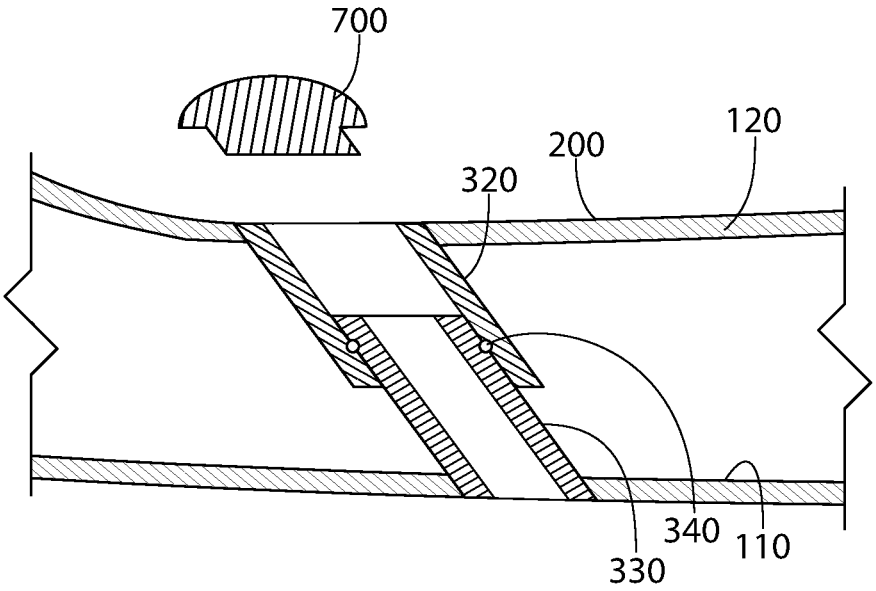
FIG. 6 is a sectional view of an example of an embodiment of the invention.
Figure 7:
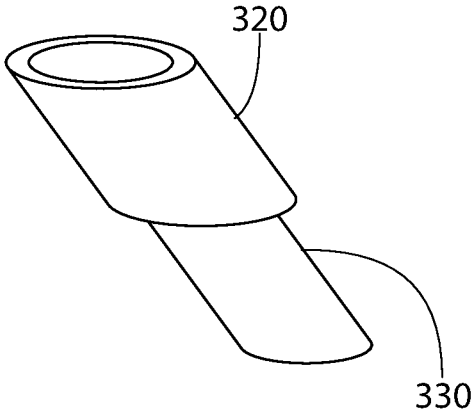
FIG. 7 is a perspective view of the embodiment shown in FIG. 6.

FIGS. 6 and 7 show an example in which an upper tube 320 is attached to deck 120 and a lower tube 330 is attached to hull 110. In this embodiment, a seal 340, such as, for example, an O-ring, is provided between upper tube 320 and lower tube 330 to create a water-tight seal. Also shown in FIG. 6 is a cap 700. Cap 700 can be used with any of the embodiments of the invention and can be fixed or removable. Cap 700 can be perforated to allow liquid to drain from foot well 200 while preventing objects larger than a certain size from entering the tube. Cap 700 can be a solid cap for use, for example, if the user wants to prevent water or another liquid from draining from foot wells 200 during, for example, use of PWC 100. FIG. 7 shows drainage system 300 of FIG. 6 detached from PWC 100. In this example, upper tube 320 and lower tube 330 are circular in cross-section. In other examples, upper tube 320 and lower tube 330 are oval or some other shape in cross section.

In embodiments, cap 700 has a top surface that is flush with foot well 200 when cap 700 is inserted into upper tube 320. In embodiments, two (or some other number) of tabs extend from inside upper tube 320 and have engagement portions that are engaged by tabs on cap 700 such that cap 700 remains attached to upper tube 320 when cap is in an open position. In embodiments, an upper surface of cap 700 lays on foot well 200 when cap 700 is in an open position such that cap 700 is pivoted 180 degrees (or some angle close to 180 degrees) from the closed position. In embodiments, cap 700 is rubber or some other resilient material. In some use modes, cap 700 is laid open while the PWC is not in use (either on a trailer or lift, or in the water, for example), and cap 700 is in the closed position when the PWC is being operated. Although this feature is described with reference to FIGS. 6 and 7, it is noted that the above optional features described above can be used with any of the embodiments of the invention. Also, some embodiments include some or all of the features of this paragraph.

Figure 8:
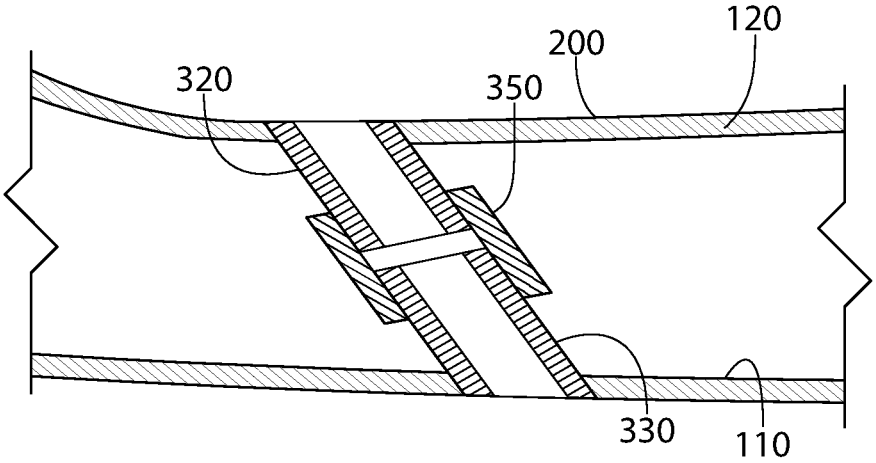
FIG. 8 is a sectional view of an example of an embodiment of the invention.
Figure 9:
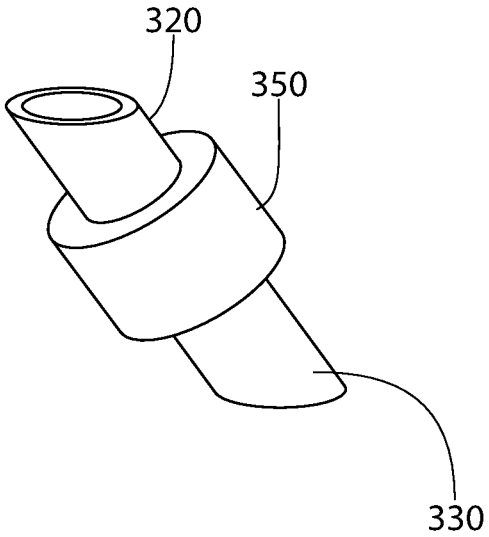
FIG. 9 is a perspective view of the embodiment shown in FIG. 8.

FIGS. 8 and 9 show an example in which upper tube 320 is attached to deck 120 and lower tube 330 is attached to hull 110. In this embodiment, a collar 350 slides over upper tube 320 and lower tube 330 to create a water-tight seal. Collar 350 can be a flexible material such as, for example, rubber or silicone, or can be a rigid material. Collar 350 can have a friction fit with one or both of upper tube 320 and lower tube 330. Collar 350 can be bonded to one or both of upper tube 320 and lower tube 330 with an adhesive, by welding, or by another fixing method. FIG. 9 shows drainage system 300 of FIG. 8 detached from PWC 100. In this example, upper tube 320 and lower tube 330 are circular in cross-section. In other examples, upper tube 320 and lower tube 330 are oval or some other shape in cross section.

Figure 10:
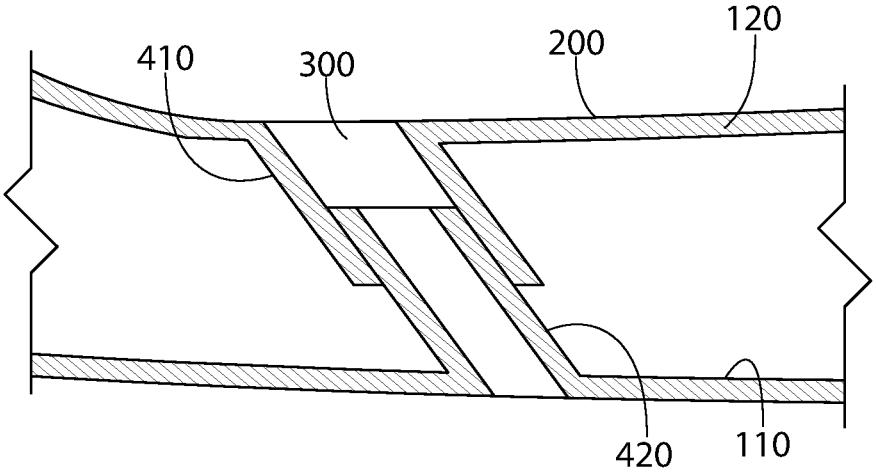
FIG. 10 is a sectional view of an example of an embodiment of the invention.

FIG. 10 shows an example of the invention that is formed into deck 120 and hull 110 when PWC 100 is manufactured. An upper tube 410 is a feature that is integral to deck 120, and a lower tube 420 is a feature that is integral to hull 110. This example shows lower tube 420 inserted into upper tube 410, but it is noted that other coupling methods (such as shown, for example, in any of the figures) can be used.

Figure 11:
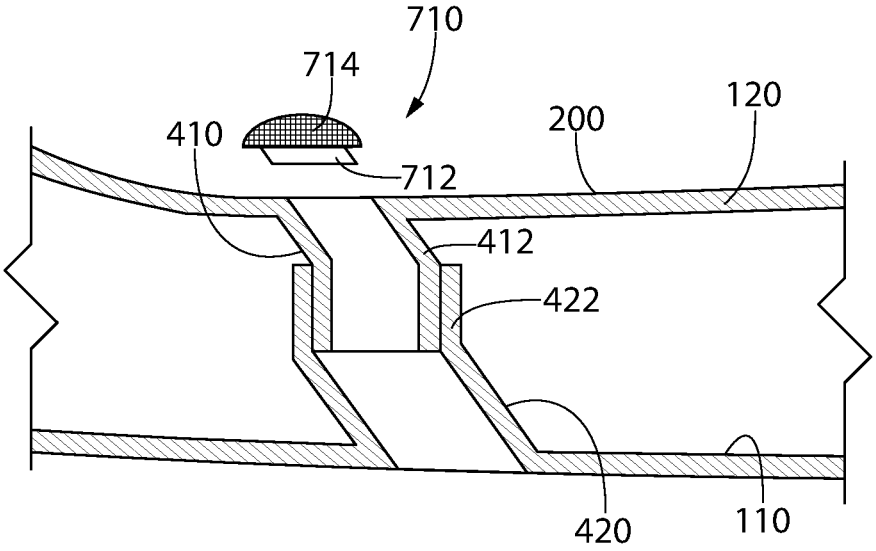
FIG. 11 is a sectional view of an example of an embodiment of the invention.

FIG. 11 shows an example which is similar to the example shown in FIG. 10, but has a configuration that could simplify manufacturing. Specifically, a straight section 412 and a straight section 422 are extensions of upper tube 410 and lower tube 420, respectively. Straight section 412 fits inside straight section 422 in this example. In other examples, straight section 422 fits inside straight section 412. By providing straight sections 412, 422, deck 120 can be lowered straight down onto hull 110 during assembly. This can be beneficial due to other constraints and requirements during assembly that are unrelated to the drainage system. In contrast, the embodiment shown in FIG. 10 might require deck 120 to be attached to hull 110 from an angle in order to align upper tube 410 and lower tube 420.

Also shown in FIG. 11 is a removable or fixed cap 710 that fits into upper tube 410 to prevent foreign matter above a certain size from entering upper tube 410. In this example cap 710 has a base portion 712 that fits with a slight interference fit into upper tube 410. In this example, cap 710 has a mesh top area 714 that allows water and small particles to pass through cap 710 and into upper tube 410. Other examples of cap 710 have a solid top area or a partially solid top area. Examples of a partially solid top area include one or more holes, slots, other openings, or one or more bars or other obstructions.

Figure 12:
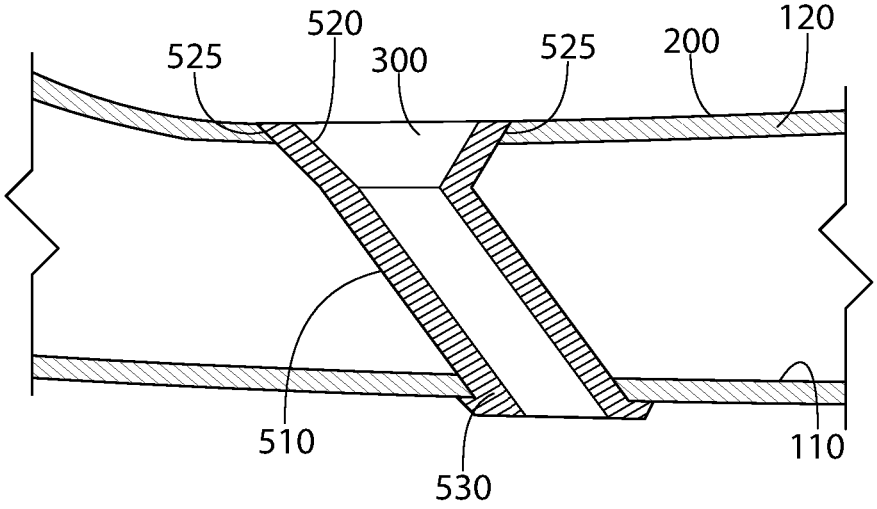
FIG. 12 is a sectional view of an example of an embodiment of the invention.

FIG. 12 shows an example of the invention that includes a funnel feature 520 at the upper end of a tube 510. Funnel feature 520 helps direct water in foot well 200 to tube 510. The example shown in FIG. 12 also shows a flange 530 located at the lower end of tube 510. Especially for retro-fitted embodiments, flange 530 can cover imperfections in the hole cut/drilled in hull 110 when tube 510 is installed in hull 110. In this embodiment, funnel feature 520 fits in a hole cut/drilled in foot well 200 and has a rim 525 that is attached (by an adhesive, for example) to an edge of the hole that is cut/drilled in foot well 200. Although the example in FIG. 12 shows a one-piece tube 510, it is noted that a two-piece tube (as shown in other embodiments, for example) can be used to facilitate installation. Particular embodiments include one or both of rim 525 and flange 530.

Figure 13:
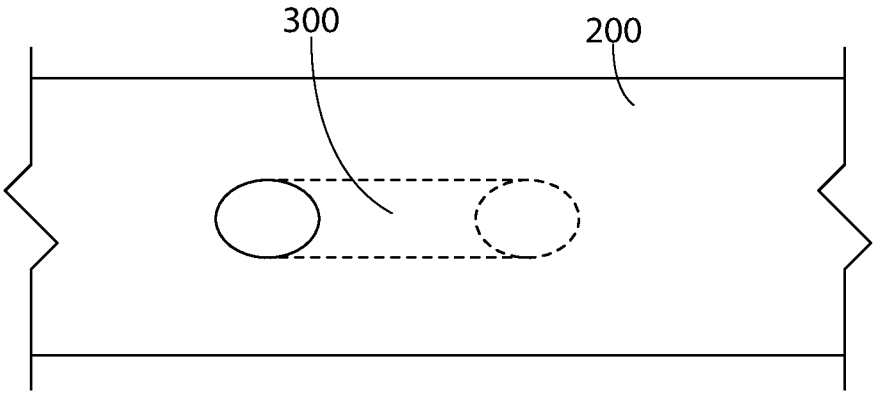
FIG. 13 is a top view of an example of an embodiment of the invention.
Figure 14:
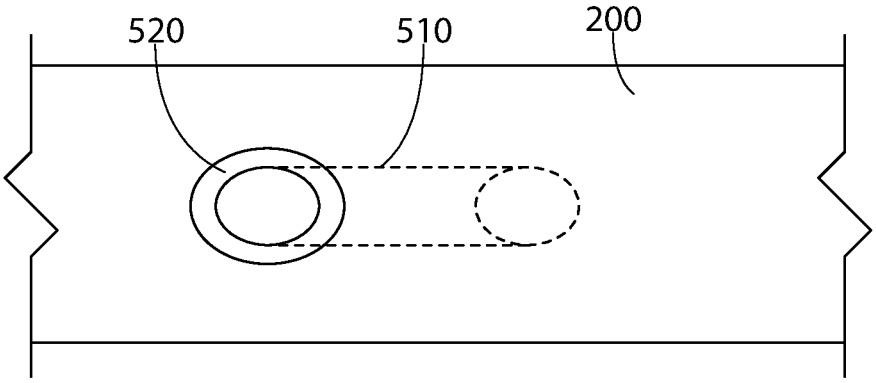
FIG. 14 is a top view of the embodiment shown in FIG. 12.

FIG. 13 shows a top view of foot well 200 with drainage system 300 installed. FIG. 14 shows a top view of foot well 200 with the embodiment shown in FIG. 12 installed. In particular embodiments where the tube has a transverse cross-section that is circular, the holes that are cut/drilled in hull 110 and foot well 200 will be oval due to angle A at which the tube is positioned relative to vertical. In particular embodiments where the tube has a transverse cross-section that is oval, the holes that are cut/drilled in hull 110 and foot well 200 will be circular due to angle A at which the tube is positioned relative to vertical.

Figure 15:
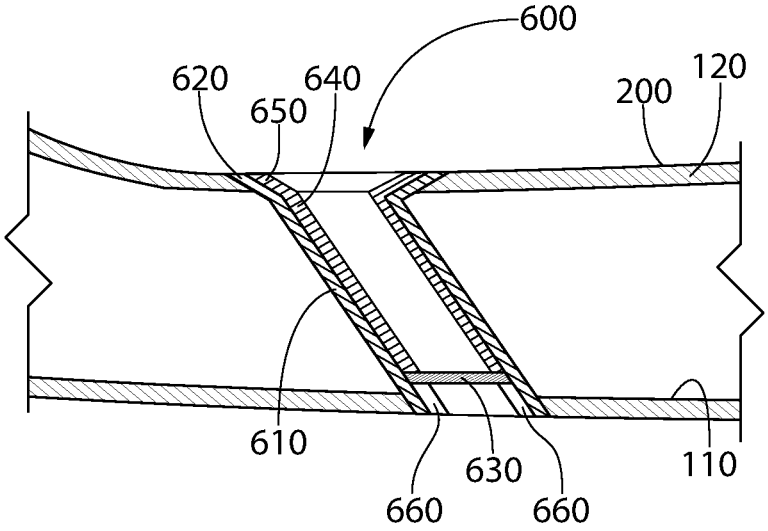
FIG. 15 is a sectional view of an example of an embodiment of the invention.
Figure 16:
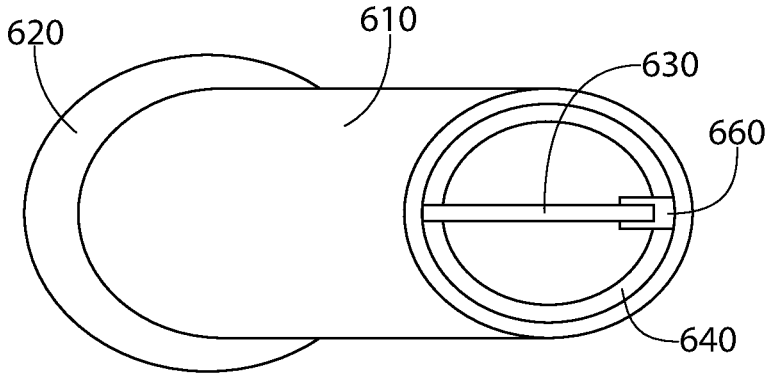
FIG. 16 is a bottom view of the example shown in FIG. 15.

FIGS. 15 and 16 show an example of embodiments of the invention in which two or more tubes are nested for various reasons. The drainage system 600 shown in FIGS. 15 and 16 has an outer tube 610 that is attached to hull 110 and foot well 200 and an inner tube 640 that is removably positioned in outer tube 610. In this example, inner tube 640 is sized to provide a draining function of foot well 200 (as described above with regard to other examples of the invention). Outer tube 610 is sized to function as a fishing rod holder (or a holder of other pole-like items such as, for example, a flag pole). In this example, outer tube 610 has a bar 630 spanning across the opening near the bottom of outer tube 610. Bar 630 can be sized to fit in the groove located in the bottom of many fishing rods. In other embodiments, rod 630 is not a particular size, but functions as a stop to prevent any pole-like item from extending out of the bottom of drainage system 600. In embodiments, two bars at an angle relative to each other (for, example at a right angle) are provided in the place of bar 630.

Embodiments include various other inserts that fit in outer tube 610. For example, an insert containing a one-way valve fits in outer tube 610. The insert containing the one-way valve can be inserted in outer tube 610 when PWC 100 is in the water to prevent water flowing from outside hull 110 to foot well 200, but to allow water to flow from foot well 200 (through drainage system 600) to outside hull 110. This can be particularly useful if the floor of foot well 200 is below the waterline of PWC 100 when PWC 100 is at a rest position in the water (stationary and floating in the water). The insert containing the one-way valve can be removed from outer tube 610 when PWC 100 is out of the water and/or not in operation to provide a larger, unobstructed flow path through outer tube 610 so that water and foreign matter can more easily drain from foot well 200.

In embodiments, a framework having one or more members can be inserted in outer tube 610 (or both outer tube 610 in the port foot well 200 and outer tube 610 in the starboard foot well 200) to support a Bimini top or other form of shade.

In embodiments, an insert can be inserted in outer tube 610 to provide a location to which a fender, anchor, line, or other device can be secured.

In the example shown in FIGS. 15 and 16, outer tube 610 has a funnel feature (or bevel) 620. Inner tube 640 has, in this example, a funnel feature (or bevel) 650 and two slots 660. Slots 660 allow inner tube 640 to fit over bar 630. While two nested tubes are shown in this example, it is noted that three or more nested tubes can be used. In addition, a plurality of inner tubes 640 having different inner diameters can be provided and selectively used depending on the desired inner diameter of the tube.

The tubes in the various embodiments of the invention have an inside diameter that can range from, for example, ⅜ of an inch to 2 inches. Particular embodiments have an inside diameter of between ¾ of an inch to 1½ inches.

The tube sections of embodiments of the invention can be a rigid material such as, for example, PVC, composites, or metal, or a flexible material such as, for example, silicone or rubber tubing. A flexible material can facilitate installation, especially in the embodiments that include a funnel feature and/or a flange.

In embodiments, more than one drainage system in accordance with the invention is installed in each foot well of the PWC. A foot well of a PWC can have a first low point when the PWC is a rest and a second low point when the PWC is being operated at high speed, with the first low point and the second low point having different locations in the foot well. In embodiments, one drainage system, for example drainage system 300, is located with its entry opening 301 at the first low point, and a second drainage system, for example drainage system 300, is located with its entry opening 301 at the second low point. With a configuration having these two drainage systems, water is drained from the foot well in both the resting position and the high speed operating state.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A personal water craft, comprising:

a hull having a fully loaded waterline, the fully loaded waterline being a line on the hull at which a surface of water in which the personal water craft is floating contacts the hull when the personal water craft is stationary and floating in the water with a maximum design weight in passengers and gear loaded on the personal water craft;

a deck attached to, or integral with, the hull;

a foot well having a foot well floor that is configured to receive a foot of a user of the personal water craft; and a drainage system configured to drain liquid from the foot well, the drainage system having a tube extending from an entry opening to an exit opening, the entry opening being in the foot well floor, and the exit opening being in an outer surface of the hull below the fully loaded waterline, wherein edges of the tube at the exit opening are in a portion of the surface of the hull that is substantially parallel to the fully loaded waterline.

2. The personal water craft of claim 1, wherein the entry opening that is located at a first elevation, the exit opening that is located at a second elevation, and the first elevation is above the second elevation.

3. The personal water craft of claim 2, wherein the entry opening is a first horizontal distance from a forward most extremity of the personal water craft, the exit opening is a second horizontal distance from the forward most extremity of the personal water craft, and the first distance is smaller than the second distance.

4. The personal water craft of claim 1, wherein the entry opening is a first horizontal distance from a forward most extremity of the personal water craft, the exit opening is a second horizontal distance from the forward most extremity of the personal water craft, and the first distance is smaller than the second distance.

5. The personal water craft of claim 1, wherein the hull has an empty waterline, the empty waterline being a line on the hull at which the surface of the water in which the personal water craft is floating contacts the hull when the personal water craft is stationary and floating in the water with no passenger or gear loaded on the personal water craft, and the exit opening is below the empty waterline.

6. The personal water craft of claim 1, wherein the entry opening is above the fully loaded waterline.

7. The personal water craft of claim 2, wherein a straight line between a center of the entry opening and a center of the exit opening is at an angle relative to vertical when the personal water craft is in a normal operating rest position, and the angle is greater than zero degrees and less than ninety degrees.

8. The personal water craft of claim 7, wherein the angle is between 30 degree and 45 degrees.

9. The personal water craft of claim 1, wherein a straight line between a center of the entry opening and a center of the exit opening is at an angle relative to vertical when the personal water craft is in a normal operating rest position, and the angle is greater than zero degrees and less than ninety degrees.

10. The personal water craft of claim 9, wherein the angle is between 30 degree and 45 degrees.

11. The personal water craft of claim 1, further comprising a cross-member extending across an interior of the tube, the cross-member being configured to support an insert and prevent the insert from passing completely through the tube.

12. The personal water craft of claim 1, wherein the tube comprises an upper tube section and a lower tube section, the upper tube section being fixed to the deck, the lower tube section being fixed to the hull, and the upper tube section and the lower tube section attaching to each other when the hull and the deck are in an operating position of the person water craft.

13. The personal water craft of claim of claim 12, wherein the upper tube section is attached to the lower tube section by a coupler.

14. The personal water craft of claim 1, further comprising a cap that is removably insertable into the entry opening, the cap obstructing at least a portion of the entry opening when the cap is installed in the entry opening.

15. The personal water craft of claim 14, wherein the cap comprises a mesh portion that is positioned above the entry opening when the cap is installed in the entry opening.

16. A drainage system for a foot well of a personal water craft, the personal watercraft having a hull, the drainage system comprising:

a tube extending from the footwell to a location outside of the hull, the tube having an entry opening configured to be located in the foot well and having a center, edges of the tube at the entry opening being substantially located in an entry plane, and an exit opening configured to be located in the hull and having a center, wherein the entry plane is non-perpendicular to a straight line through the center of the entry opening and the center of the exit opening, and the exit opening is in a surface of the hull that is substantially horizontal when the personal water craft is floating in a normal resting position.

17. The drainage system of claim 16, wherein an angle between the straight line and the entry plane is between 30 degree and 45 degrees.

18. A personal water craft, comprising:

a hull;

a deck attached to, or integral with, the hull;

a foot well having a foot well floor that is configured to receive a foot of a user of the personal water craft, the foot well floor being higher in elevation than a lowest part of the hull; and a drainage system configured to drain liquid from the foot well, the drainage system having a discrete passageway extending from an entry opening in the foot well floor to an exit opening located in an outer surface of the hull, wherein a straight line passes unobstructed through the discrete passageway between the entry opening and the exit opening.

19. The personal water craft of claim 18, wherein the passageway extends directly from the entry opening in the footwell to the exit opening at the location in the outer surface of the hull, the entry opening is located at a first elevation, the exit opening is located at a second elevation, and the first elevation is above the second elevation.

20. The personal water craft of claim 18, wherein the passageway extends directly from the entry opening in the footwell to the exit opening at the location in the outer surface of the hull, the entry opening is a first horizontal distance from a forward most extremity of the personal water craft, the exit opening is a second horizontal distance from the forward most extremity of the personal water craft, and the first distance is smaller than the second distance.

* * * * *